US005414900A

United States Patent [19]

Gillum et al.

[11] Patent Number: 5,414,900

[45] Date of Patent: * May 16, 1995

[54] FIBER CLEANING

[75] Inventors: Marvis N. Gillum; Sidney E. Hughs, both of Las Cruces, N. Mex.

[73] Assignee: The United States of America as represented by the Secretary of Agriculture, Washington, D.C.

[ * ] Notice: The portion of the term of this patent subsequent to Mar. 22, 2011 has been disclaimed.

[21] Appl. No.: 196,734

[22] Filed: Feb. 15, 1994

Related U.S. Application Data

[63] Continuation-in-part of Ser. No. 997,478, Dec. 28, 1992, Pat. No. 5,295,283, which is a continuation of Ser. No. 820,473, Jan. 14, 1992, Pat. No. 5,173,994.

[51] Int. Cl.[6] ..... D01G 15/12; D01G 15/02

[52] U.S. Cl. ..... 19/55 R; 19/200; 19/202; 19/57

[58] Field of Search ..... 19/55 R, 57, 105, 107, 19/200, 202

[56] References Cited

U.S. PATENT DOCUMENTS

| | | | |
|---|---|---|---|
| 21,714 | 10/1858 | Withers | 19/57 |
| 379,760 | 3/1888 | Broh | 19/55 R |
| 2,064,602 | 12/1936 | Harris | 19/57 |
| 2,244,542 | 6/1941 | Morsam | 19/55 R |
| 2,739,353 | 3/1956 | Mitchell et al. | 19/57 |
| 2,825,096 | 3/1958 | Moss | 19/57 |
| 2,951,265 | 9/1960 | Kotter et al. | 19/57 |
| 4,507,827 | 4/1985 | Staadili | 19/200 |
| 4,528,725 | 7/1985 | Horn et al. | 19/202 X |
| 5,173,924 | 12/1992 | Gillam et al. | 19/55 R |
| 5,295,283 | 3/1994 | Gillam et al. | 19/55 R |

*Primary Examiner*—John J. Calvert
*Attorney, Agent, or Firm*—M. Howard Silverstein; Randall E. Deck; John D. Fado

[57] ABSTRACT

The present invention is drawn to fiber cleaning utilizing an alternating series of cleaning saw cylinders and doffing brush cylinders. The doffing brush cylinders transfer ginned fiber from an upstream cleaning saw cylinder to the next downstream cleaning saw cylinder in such a way that the flow of the fiber changes direction at the pinch point between the downstream cleaning saw cylinder and the doffing brush cylinder. Guiding means including control bars are provided to help guide the ginned fiber from the doffing brush cylinder to the next downstream cleaning saw cylinder at the pinch point. Flow deflecting means including air control bars are provided to deflect a substantial portion of the flow of entrained air from flowing around the doffing brush cylinder.

20 Claims, 4 Drawing Sheets

FIBER CLEANING

CROSS REFERENCE TO RELATED APPLICATION

This is a continuation-in-part of application Ser. No. 07/997,478, filed Dec. 28, 1992, now U.S. Pat. No. 5,295,283, which is a continuation of application Ser. No. 07/820,473, filed Jan. 14, 1992, now U.S. Pat. No. 5,173,994.

FIELD OF THE INVENTION

The present invention relates to an apparatus and process for cleaning foreign matter from fiber.

BACKGROUND OF THE INVENTION

In harvesting, seed cotton is stripped or picked from the plant, deposited in a trailer or other vehicle, and transported to a cotton gin. The cotton gin has apparatus for receiving the seed cotton, removing the seeds, cleaning the cotton fiber, and pressing the fiber into bales for transport to textile mills or compresses for further operation.

Prior to the present invention, trash or foreign matter in cotton fiber, or lint, presented significant problems to cotton producers and textile mills. High trash contents reduces the price the producer receives for the product. Efforts to further clean the fiber in the gin to reduce trash levels caused fiber damage by breaking and tangling the fiber. This fiber damage decreases the quality of the resulting yarn and cloth. The present invention performs the fiber cleaning needed by the producer for good returns without causing damage to the fiber which would reduce the quality of textiles made from the fiber.

U.S. Pat. No. 4,528,725 to Horn et al discloses a gin lint cleaner that utilizes a feed plate to direct the ginned fiber onto a downstream saw cylinder. Horn et al then uses sharp-edged grid bars to further engage the ginned fiber with the downstream cylinder. The action of a second downstream saw cylinder and deflector remove the lint from the first cylinder and deposit the lint onto a second cylinder. Horn et al then uses round blunt bars, a seating bar, sharp-edged grid bars, a trash bar, and a combing bar. Between the feed plate, saw to saw interaction, and the combing bars, the ginned fiber is subject to considerable abrasion which tends to cause more fiber breakage. Therefore, there is still a need in the art for more efficient gin fiber cleaning which is capable of cleaning fiber with lower levels of fiber breakage and at lower energy costs.

SUMMARY OF THE INVENTION

In accordance with the present invention, there are provided fiber cleaning processes and apparatus which solve the problems identified above with regard to cleaning fiber. In describing the cylinders of the present invention, it will be understood that each cylinder rotates about an axis. Various bar devices are positioned adjacent and along the cylinders, parallel the axes.

The present invention combines the use of guiding means (including feed control bars) and flow deflecting means (including air control bars) to produce fiber cleaning that uses less power, breaks fewer fibers and results in less tangling of the fiber.

Doffing brush cylinders mechanically remove the ginned fiber from an upstream saw cylinder and transfers the fiber to the next downstream fiber cleaning saw cylinder, or in the case of the last downstream doffing brush cylinder, to a bale press. The transfer of ginned fiber takes place such that the flow of fiber changes direction at the pinch point between the downstream saw cylinder and the doffing brush cylinder. The pinch point is the point of contact or nearest proximity of an upstream cylinder with the next downstream cylinder. The tangential speed of the outer periphery of the doffing brush cylinders is preferably set between 1.25 and 2 times the tangential speed of the outer periphery of the upstream saw cylinder.

As the ginned fiber is being rotated on the doffing brush cylinder and about to be transferred to a downstream cleaning saw cylinder the ginned fiber has a tendency to lift off the doffing brush cylinder before reaching the pinch point. Guiding means, including feed control bars, are provided by the present invention to help keep the ginned fiber on the doffing brush cylinder and guide the transfer of the ginned fiber from the doffing brush cylinder to the next downstream cleaning saw cylinder up to the pinch point.

Normally, entrained air along the outer periphery of the doffing brush cylinders continues to rotate beyond the pinch point of the downstream cleaning saw cylinder. The entrained air continues to flow to the point where the doffing brush cylinder again removes ginned fiber from an upstream saw cylinder. If fiber is allowed to travel with the entrained air back to the pinch point of the upstream saw cylinder and the doffing brush cylinder, the recirculated fiber increases the tangling of all the fiber, and thereby adversely affects the nep count of the fiber.

The present invention provides flow deflecting means including air control bars to deflect a substantial portion of the flow of entrained air from, flowing around the doffing brush cylinder toward an upstream cleaning saw cylinder. By use of the air control bars, the entrained air will instead be deflected to flow counter rotationally around the next downstream cleaning saw cylinder. The air control bar is placed opposite the flow control bar adjacent the pinch point of a doffing brush cylinder and a fiber cleaning saw cylinder, on the non-fiber flow side of the pinch point.

In addition, an air control bar is placed immediately downstream of the point where the ginned fiber is removed from the last doffing brush cylinder and removed from the ginned fiber cleaning housing.

The specific nature of the invention, as well as other objects, uses, and advantages thereof, will clearly appear from the following description and from the accompanying drawings, which are not necessarily to scale.

DESCRIPTION OF THE PREFERRED EMBODIMENTS

In a typical cotton gin process flow, cotton is harvested in the field and transported to the location of a cotton gin building. The delivered cotton, which is sometimes referred to as seed cotton, contains foreign matter or trash, which may include stalks, stems, leaves, bark, and boll pieces. The foreign matter may also include small pebbles, dirt, sand, weeds, seeds and other trash which the harvesting equipment may have picked up.

The seed cotton is fed to one or more gin stand saw cylinders where the seeds are separated from the lint, or fiber cotton. The ginned cotton fiber still contains foreign matter after being processed by the gin stand cylinder. Therefore, the ginned cotton fiber is transported to a fiber cleaner, and from the fiber cleaner to a lint bale press (not shown).

Figure 1:
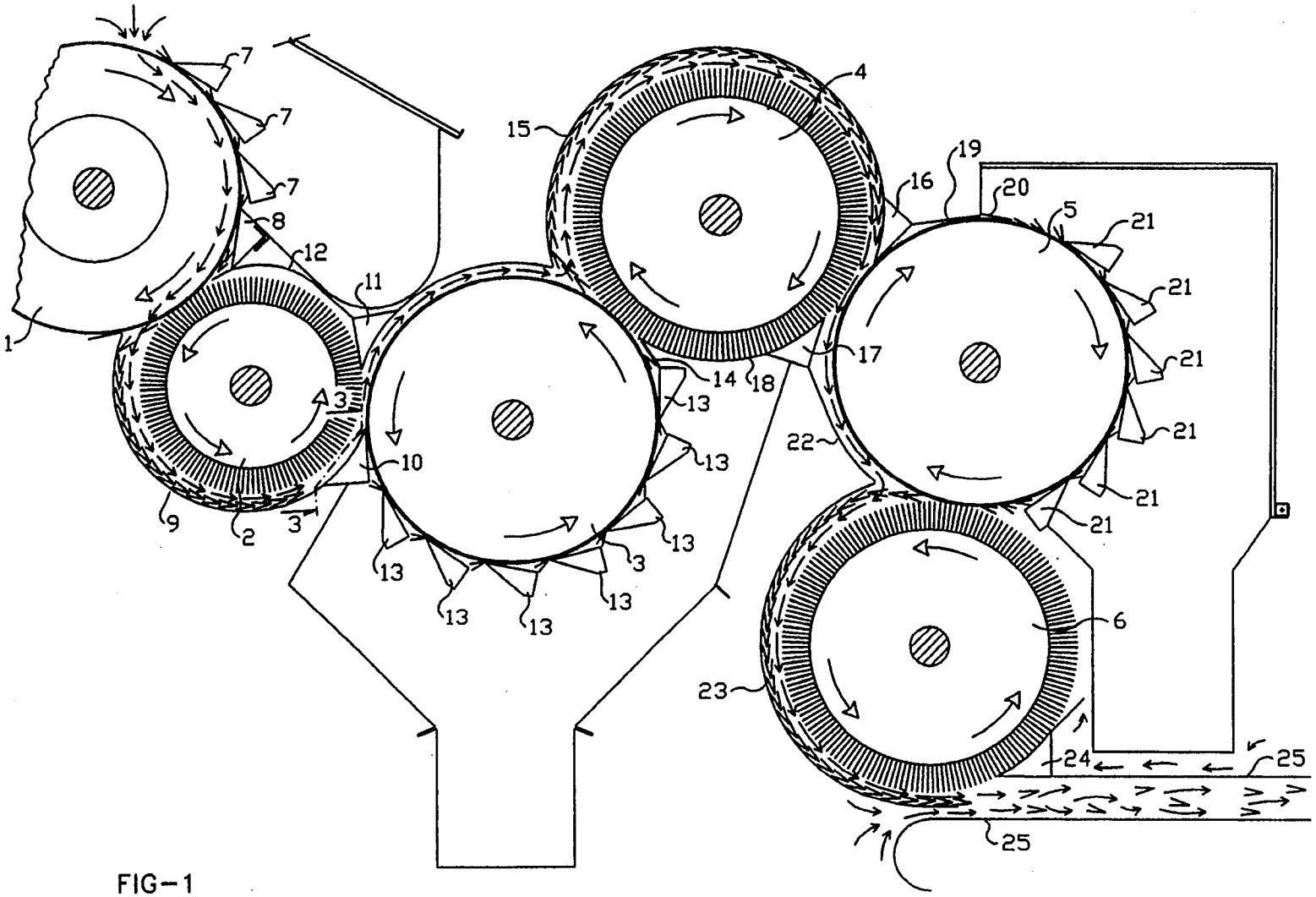
FIG. 1 is a schematic diagram of a side elevation view of a preferred gin fiber cleaner of the present invention.

FIG. 1 shows a preferred embodiment of a cotton fiber cleaner of the present invention. The figure shows a first ginning means for separating fiber and seed, including a gin housing having a gin saw cylinder 1 (i.e. gin stand cylinder), as well as fiber cleaning means including two fiber cleaning saw cylinders 3 and 5. The gin stand saw cylinder and two fiber cleaning saw cylinders are rotationally driven by a manner well known in the art, such as a motor connected by a drive belt to a drive pulley which is integrally attached to the cylinder.

It is understood that the ginning means (i.e. gin saw cylinder 1) and the fiber cleaning means (including doffing brush cylinders 2, 4 and 6, and fiber cleaning saw cylinders 3 and 5) may be constructed as a single, integral unit. Alternatively, the fiber cleaning means may be constructed as a separate unit which may be combined with or "retrofitted" to an existing gin to receive ginned fiber therefrom for cleaning.

For clarity, only the cotton fiber feed assembly is shown in FIG. 1. Likewise, much of the structure shown in FIG. 1, such as the sheet metal walls forming the trash disposal, and airflow control ducts and brackets for mounting are not shown. Those skilled in the art will be able to supply the necessary frame, covers, baffles, duct-work, mounting brackets and other omitted structure based on the disclosure herein and knowledge of the gin lint cleaning art.

With regard to the figures hereof, it will be understood that the arrows inside each cylinder represent the direction of rotation of that cylinder, and hence the direction of teeth or other structure attached thereon. Arrows outside the cylinders represent the direction of flow of trash and foreign matter or air flow, as appropriate. The flow of fiber is shown as a herringbone band on the outer periphery of the cylinders. Cylinders 1, 4 and 5 are rotating clockwise, while cylinders 2, 3 and 6 are rotating counter-clockwise as viewed in FIG. 1.

Cylinders 2, 4 and 6 are doffing brush cylinders which are part of the fiber transporting or removing means. The doffing brush cylinders are preferably constructed as solid spiral-wrapped brushes. The doffing brush cylinders mechanically remove the ginned cotton fiber from the respective upstream saw cylinder 1, 3 and 5. The transfer of ginned cotton fiber takes place such that the flow of cotton fiber abruptly changes direction at the pinch point between a downstream cleaning saw cylinder and the next upstream doffing brush cylinder. The tangential speed of the outer periphery of the doffing brush cylinders is preferably between 1.25 and 2 times the tangential speed of the outer periphery of the respective upstream saw cylinder.

Figure 2:
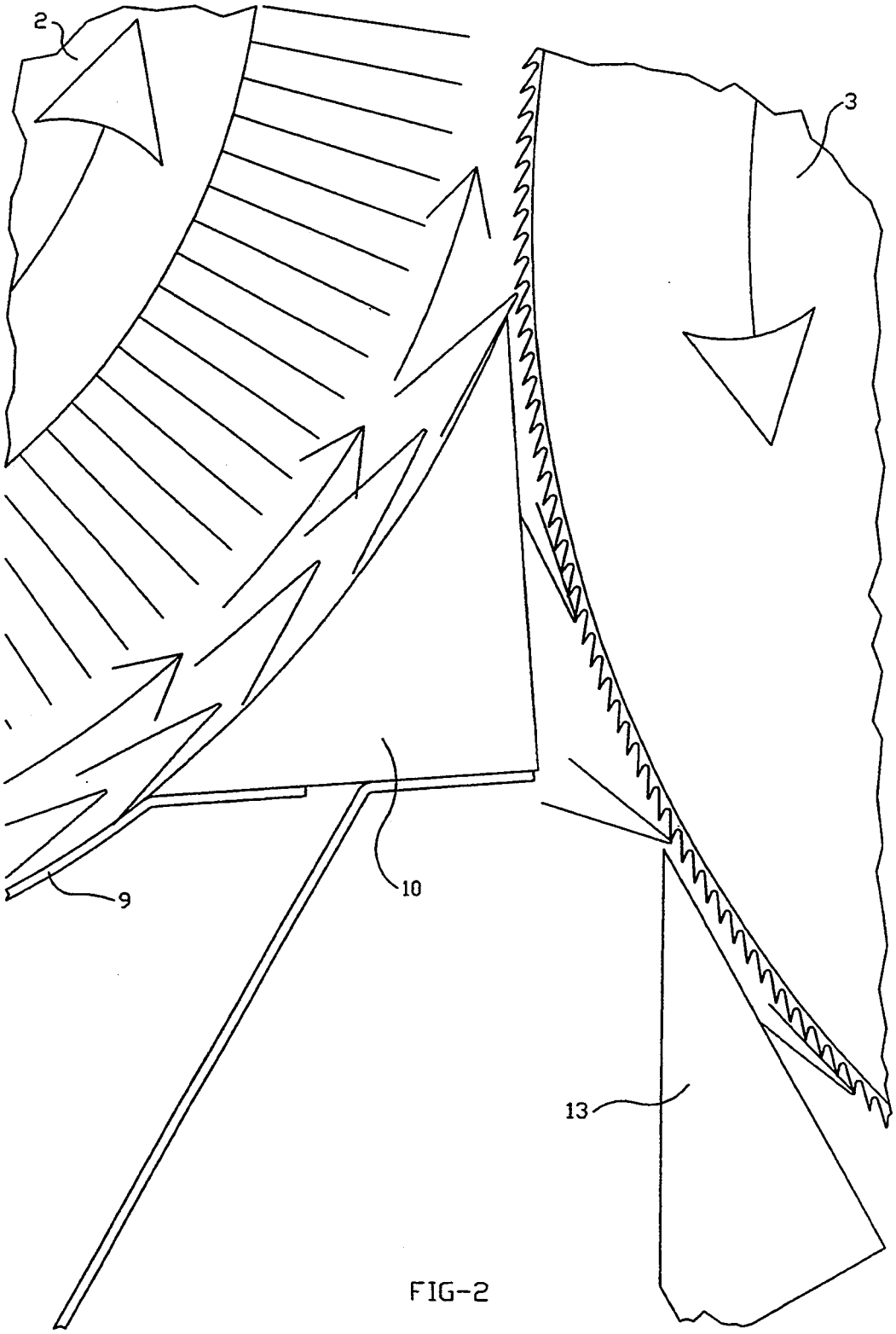
FIG. 2 is a large scale side view of a feed control bar of the present invention which has a substantially triangular cross-section with the hypotenuse being an arcuate surface which is parallel to the outer peripheral surface of the immediate upstream doffing brush cylinder.
Figure 3:
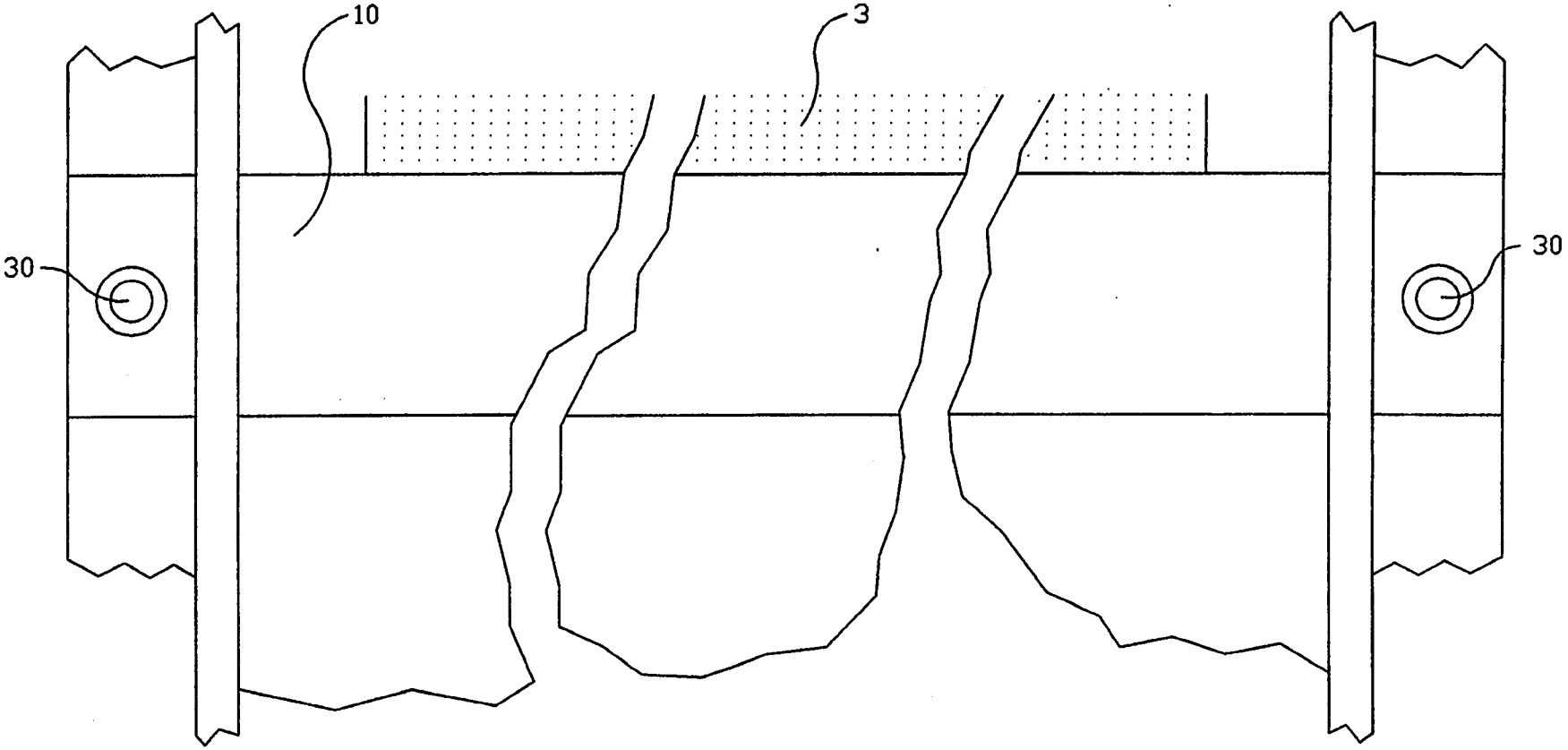
FIG. 3 is a front view of a feed control bar of the present invention.

The fibers, which are attached to gin saw cylinder 1 after being separated from the seed (ginned), are doffed by doffing brush cylinder 2 at the pinch point between cylinders 1 and 2. The fibers exit the pinch point tangentially and proceed substantially in a straight line until impacting contact 9. The fibers continue on the surface of containment 9 and feed control bar 10, being propelled by the induced air near the brush surface until engaged by the teeth of cleaning saw cylinder 3. The feed control bars 10 and 16 have an arcuate surface which is parallel to the outer peripheral surface of the doffing brush cylinders 2 and 4, respectively, adjacent to the pinch point. The feed control bars 10 and 16 are substantially triangular in cross-section with the hypotenuse of the triangle being the arcuate surface (FIG. 2). The feed control bars 10 and 16 extend substantially the entire length of the doffing brush and cleaning saw cylinders and are attached at each end to the gin housing (FIG. 3). The feed control bars 10 and 16 form a sharp point adjacent to the pinch point. The feed control bars 10 and 16 are placed as close as practical to the cleaning saw cylinders 3 and 5, respectively, as well as close as practical up to the pinch point between the doffing brush cylinder and the next downstream cleaning saw cylinder.

Figure 4:
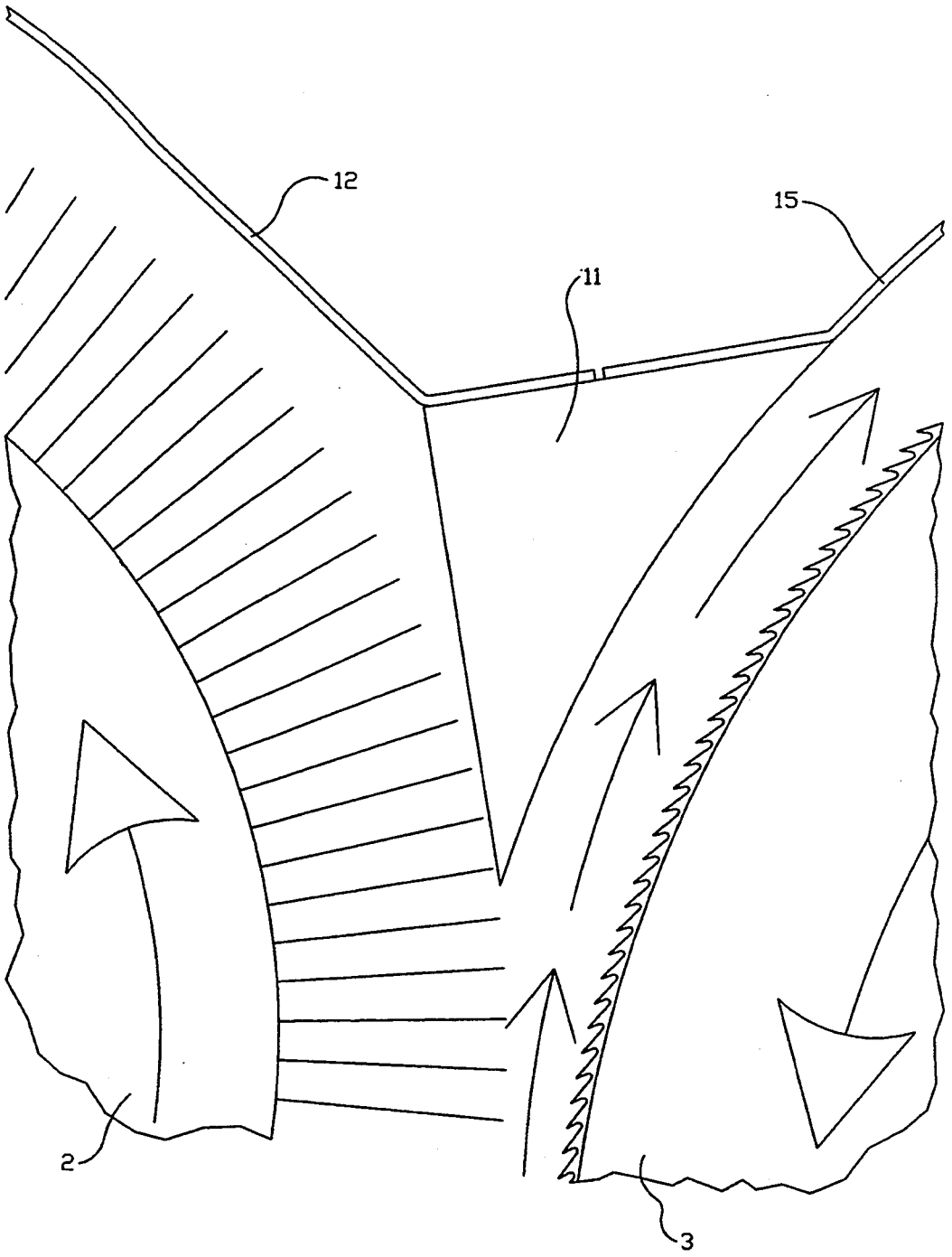
FIG. 4 is a side view of an air control bar of the present invention, shown in large scale.

In the present invention, flow deflecting means, including air control bars 11, 17 and 24, are used to deflect the flow of entrained air from continuing to flow around the doffing brush cylinder. Instead the air is deflected toward the next downstream cleaning saw cylinder. For example, the air control bar 11, located between doffing brush cylinder 2 and cleaning saw cylinder 3, deflects the flow of entrained air freon continuing around doffing brush cylinder 2 to flowing in the annular space between cleaning saw cylinder 3, which is rotating in the opposite direction to the flow of deflected air, and contact 15 (FIG. 4). Air control bar 11 has an arcuate surface which is parallel to the outer peripheral surface of the next downstream cleaning saw cylinder.

Without the flow deflecting means, entrained air along the outer periphery of the doffing brush cylinder continues to rotate beyond the pinch point of the downstream cleaning saw cylinder. The entrained air would continue to rotate along the outer periphery to the point where the doffing brush cylinder again removes ginned fiber from an upstream cylinder. It is believed that this entrained air promotes tangling of the fiber, thereby increasing the nep count.

The air control bar 11 prevents substantially all of the air from continuing to flow in the annular space between cylinder 2 and containment 12. Any air that does flow in the annular space between cylinder 2 and containment 12 is directed tangentially in a manner which does not alter the path of the fiber being doffed at the pinch point between cylinders 1 and 2. Eventually, most of the deflected air will be entrained around the outer periphery of doffing brush cylinder 4 (FIG. 1). The air control bar 17 has an arcuate surface which is substantially parallel to the outer peripheral surface of the doffing brush cylinder 4 adjacent to the pinch point. Containnment 18 and fiber guide 14 prevent entrainment of trash which was previously thrown out. Fiber guide 14, which runs the length of doffing brush cylinder 4, prevents the doffing brush cylinder from contacting the fiber until the fiber is near the pinch point, thereby aiding in the doffing action. Air flow continues in the annular space between cleaning saw cylinder 5 and containment 22, and is entrained with the fiber between doffing brush cylinder 6 and containment 23. The entrained air exits the gin housing in lint flue 25. The air control bars 11, 17 and 24 are substantially triangular in cross-section with the hypotenuse of the triangle being the arcuate surface. The air control bars 11, 17 and 24 extend substantially the entire length of the doffing and cleaning cylinders. The air control bars 11 and 17 form a sharp point adjacent the pinch point. The air control bars 11, 17 and 24 are placed as close as practical to the doffing brush cylinder. The air control bars 11 and 17 are placed as close as practical up to the pinch point between the doffing brush cylinder and the downstream cleaning saw cylinder. The air control bars 11 and 17 are placed opposite the feed control bars 10 and 16 between the pinch point of the doffing brush cylinder and the fiber cleaning saw cylinder on the non-fiber flow side of the pinch point. Also, the arcuate surface of each of the air control bars 17 and 24 is parallel to the outer peripheral surface of the next upstream doffing brush. Both the feed control bars and the air control bars define: a first planar rectangular surface, a second planar rectangular surface oriented at approximately a right angle to the first surface, and an arcuate surface joined to both said first and second surfaces.

In addition, an air control bar 24 is placed downstream of the point where the ginned fiber is removed from the last doffing brush cylinder and removed from the gin housing. The air control bar 24 is placed such that it is immediately downstream of, and substantially mates with, the last downstream doffing brush cylinder.

Transferring and inverting the ginned fiber between two counter-rotating cleaning saw cylinders exposes beth sides or surfaces of the ginned fiber to cleaning devices. For example, the cleaning bars 13 and 21 in FIG. 1, which are situated adjacent to the cleaning saw cylinders in the moting area, clean the side of the fiber facing away from the cleaning saw cylinder. The fiber is inverted during transfer from one cleaning saw cylinder to another, and additional cleaning takes place during transfer at the pinch point. Thus, in addition to providing more peripheral area for the use of cleaning devices, the use of two or more cleaning saw cylinders permits cleaning of both sides of the fiber. More peripheral area for cleaning is also available on gin cylinder 1 with cleaning bars 7 and 8.

Cleaning bars 13 and 21 are mounted to the housing and are parallel the axes, adjacent to the cleaning saw cylinders 3 and 5. The bars 13 and 21 have sharp edges parallel the cylinder axes. As the cleaning saw cylinders move the cotton fiber past the bars 13 and 21, the fiber is scrubbed against the edges. This disturbance of the fiber, in combination with centrifugal force and gravity, loosens foreign matter from the cotton fibers in the layer. The trash is then carried to a trash conveyor (not shown). The bars 13 and 21 are placed an effective distance from the cleaning saw cylinders. That is, at a distance which is effective for removing trash from the fiber, but not so close as to result in fiber damage.

Referring to FIG. 1, it may be seen that the pinch points are each radially separated by more than 180 degrees. This results in the staggered, or zig-zag arrangement of the cleaning and doffing brush cylinders. This staggered arrangement exposes more of the periphery of the cleaning saw cylinders in the path of the layer for the installation and utilization of cleaning devices such as the cleaning bars previously described.

It will be understood that additional fiber cleaning saw cylinders could be placed downstream of doffing brush cylinder 6 for additional cleaning capacity. In addition, for minimal cleaning capacity, the gin building housing could be constructed with only cylinders 1, 2, 3 and 4. However, in the preferred embodiment shown in FIG. 1, two fiber cleaning saw cylinders are used so that each side of the cotton fiber is cleaned once.

It will also be understood that the terms "upstream" or "downstream" are dependent upon the position of the referenced cylinder. The terms "upstream" and "downstream" are not restricted to the first or last cylinders, respectively.

Each of the fiber cleaning saw cylinders 3 and 5 have drive means connected thereto (not shown) for rotating the cylinders counter to each other. Each of the fiber cleaning saw cylinders has a plurality of saw teeth attached to and spaced over a surface thereof. An appropriate frame (not shown) supports the mounted cylinders and structure positioned thereabout.

The operation of the cotton gin of FIG. 1 is as follows. The cotton fiber enters the gin housing and is fed to the gin saw cylinder 1 (i.e. gin stand cylinder). The seed is separated from the fiber whereupon the ginned fiber is removed from the gin saw cylinder by counter rotating doffing brush cylinder 2. The ginned fiber is then transferred to a first fiber cleaning saw cylinder 3. Saw cylinder 3 is rotating in the same (counter-clockwise) direction as doffing brush cylinder 2. The ginned fiber thereby changes directions when it is transferred from doffing brush cylinder 2 to saw cylinder 3 at the pinch point. One side of the ginned fiber is then cleaned by cleaning bar 13 as the ginned fiber rotates past them. The ginned fiber is then removed and inverted from the first fiber cleaning saw cylinder 3 by a second counter rotating doffing brush cylinder 4. The ginned fiber is then transferred to a second fiber cleaning saw cylinder 5 at the pinch point between cylinders 4 and 5. Cylinder 5 is rotating in the same direction (clockwise) as doffing brush cylinder 4. Therefore, the ginned fiber changes direction as it is transferred from the second doffing brush cylinder 4 to the second fiber cleaning saw cylinder 5 at the pinch point. Containment 19 and adjustable fiber guide 20 prevent excess fiber loss. The other side of the ginned fiber is then cleaned by the cleaning bars 21 as the ginned fiber rotates past them. The ginned fiber is then removed from the second fiber cleaning saw cylinder 5 by third doffing brush cylinder 6. The cleaned ginned fiber is then removed from the third doffing brush cylinder 6 and removed to downstream baling apparatus via lint flue 25.

FIG. 3 is a front view of feed control bar 10 in relation to cleaning saw cylinder 3. The bar is attached to the gin housing by attachment means 30.

Various changes and modifications may be made in this invention, as may be apparent to those skilled in the art. Such changes and modifications are within the scope of this invention, as defined by the claims appended hereto.

Index of Elements Designated by a Numeral

1 gin saw cylinder
2 doffing brush cylinder
3 fiber cleaning saw cylinder
4 doffing brush cylinder
5 fiber cleaning saw cylinder 6 doffing brush cylinder
7 cleaning bar
8 cleaning bar
9 containment
10 feed control bar
11 air control bar
12 containment
13 cleaning bar
14 fiber guide
15 containment
16 feed control bar
17 air control bar
18 containment
19 containment
20 adjustable fiber guide
21 cleaning bar
22 containment
23 containment
24 air control bar
25 lint flue
30 attachment means

What is claimed is:

1. An apparatus for cleaning ginned fiber comprising:

(a) first fiber cleaning means including a first fiber cleaning saw cylinder having a toothed outer peripheral surface;

(b) first fiber transporting means including a first doffing brush cylinder having an outer peripheral surface, operably associated with said first fiber cleaning saw cylinder, for transporting ginned fiber to said first fiber cleaning saw cylinder, said first doffing brush cylinder rotating in the same angular direction as said first fiber cleaning saw cylinder;

(c) second fiber transporting means including a second doffing brush cylinder having an outer peripheral surface, operably associated with said first fiber cleaning saw cylinder, for mechanically removing said fiber from said first fiber cleaning saw (d) guiding means for guiding transfer of said fiber from said first doffing brush cylinder to said first fiber cleaning saw cylinder, said guiding means including a first feed control bar having an arcuate surface which is parallel to said outer peripheral surface of said first doffing brush cylinder adjacent to a pinch point where said fiber is transferred from said first doffing brush cylinder to said first fiber cleaning saw cylinder.

2. The apparatus of claim 1 further including:

(a) a second fiber cleaning saw cylinder downstream of said second doffing brush cylinder;

(b) second guiding means for guiding transfer of said ginned fiber from said second doffing brush cylinder to said second fiber cleaning saw cylinder, said second guiding means including a second feed control bar having an arcuate surface which is parallel to said outer peripheral surface of said second doffing brush cylinder adjacent to a second pinch point where said ginned fiber is transferred from said second doffing brush cylinder to said second fiber cleaning saw cylinder;

(c) means operably associated with said second fiber cleaning saw cylinder, including a third doffing brush cylinder having an outer peripheral surface, for mechanically removing said ginned fiber from said second fiber cleaning saw cylinder.

3. The apparatus of claim 2 further including:

(a) flow deflecting means for deflecting flow of entrained air around said third doffing brush cylinder towards an outlet of said apparatus, said flow deflecting means including an air control bar, having an arcuate surface which is parallel to said outer peripheral surface of said third doffing brush cylinder, adjacent to a point where said ginned fiber is transferred from said third doffing brush cylinder to said outlet, said flow deflecting means being opposite said point on a non-fiber flow side of said point.

4. The apparatus of claim 3 wherein said first and second feed control bars and said air control bar are all approximately triangular in cross-section.

5. The apparatus of claim 4 wherein said first and second feed control bars and said air control bar all define a sharp point adjacent a said point where said ginned fiber is transferred.

6. The apparatus of claim 5 wherein each said bar defines: a first planar rectangular surface, a second planar rectangular surface oriented at approximately a right angle to said first surface, and an arcuate surface joined to both said first and second surfaces.

7. The apparatus of claim 1 wherein said first feed control bar is approximately triangular in cross-section.

8. The apparatus of claim 7 wherein said first feed control bar forms a sharp point adjacent said pinch point.

9. The apparatus of claim 8 wherein said first feed control bar defines: a first planar rectangular surface, a second planar rectangular surface oriented at approximately a right angle to said first surface, and an arcuate surface joined to both said first and second surfaces.

10. The apparatus of claim 2 further including means for rotating said said second doffing brush cylinder and said second fiber cleaning saw cylinder in one direction, and for rotating said first doffing brush cylinder, said first fiber cleaning saw cylinder and said third doffing brush cylinder in the opposite direction.

11. A method of cleaning ginned fiber including the steps of:

(a) transporting ginned fiber to a first fiber cleaning means including first fiber cleaning saw cylinder via a first doffing brush cylinder, said first doffing brush cylinder rotating in the same angular direction as said first fiber cleaning saw cylinder;

(b) utilizing first guiding means to guide transfer of said fiber from said first doffing brush cylinder to said first fiber cleaning saw cylinder so that said fiber stays on said first doffing brush cylinder until said fiber reaches a first pinch point between said fire doffing brush cylinder and said first cleaning saw cylinder, and at which said pinch point said fiber changes direction as it is engaged by said first fiber cleaning saw cylinder;

(c) transferring said fiber from said first fiber cleaning saw cylinder to a second doffing brush cylinder.

12. The method of cleaning fiber as recited in claim 11 further including the steps of:

(a) transporting said fiber from said second doffing brush cylinder to a second fiber cleaning saw cylinder;

(b) utilizing second guiding means to guide transfer of said fiber from said second doffing brush cylinder to said second fiber cleaning saw cylinder so said fiber stays on said second doffing brush cylinder until said fiber reaches a second pinch point between said second doffing brush cylinder and said second fiber cleaning saw (c) transferring said fiber from said second fiber cleaning saw cylinder to a third doffing brush cylinder.

13. The method of cleaning fiber of claim 12 further including flow deflecting means for deflecting flow of entrained air around said third doffing brush cylinder towards an outlet of a housing.

14. The method of claim 13 wherein said first guiding means, second guiding means, and said flow deflecting means, all include a bar which is approximately triangular in cross-section.

15. The method of claim 14 wherein said bars each define a sharp point, each said sharp point being positioned adjacent a point where fiber is transferred.

16. The method of claim 15 wherein each said bar defines: a first planar rectangular surface, a second planar rectangular surface oriented at approximately a right angle to said first surface, and a third arcuate surface joined to both said first and second surfaces.

17. The method of claim 11 wherein said first guiding means includes a bar which is approximately triangular in cross-section.

18. The method of claim 17 wherein said bar forms a sharp point adjacent said pinch point.

19. The method of claim 18 wherein said bar defines: a first planar rectangular surface, a second planar rectangular surface oriented at approximately a right angle to said first surface, and a third arcuate surface joined to both said first and second surfaces.

20. The method of cleaning fiber of claim 12 wherein said second doffing brush cylinder and said second fiber cleaning saw cylinder are rotated in one direction, while said first doffing brush cylinder, said first fiber cleaning saw cylinder and said third doffing brush cylinder are rotated in the opposite direction.

* * * * *